US011833389B2

(12) United States Patent
Petrone

(10) Patent No.: US 11,833,389 B2
(45) Date of Patent: Dec. 5, 2023

(54) ATHLETIC TRAINING DEVICE FOR STRIDE TRAINING

(71) Applicant: Matthew Ross Petrone, Mahopac, NY (US)

(72) Inventor: Matthew Ross Petrone, Mahopac, NY (US)

( * ) Notice: Subject to any disclaimer, the term of this patent is extended or adjusted under 35 U.S.C. 154(b) by 0 days.

(21) Appl. No.: 17/221,094

(22) Filed: Apr. 2, 2021

(65) Prior Publication Data

US 2021/0308521 A1 Oct. 7, 2021

Related U.S. Application Data

(60) Provisional application No. 63/004,089, filed on Apr. 2, 2020.

(51) Int. Cl.
*A63B 23/04* (2006.01)
*A63B 69/00* (2006.01)
(Continued)

(52) U.S. Cl.
CPC ..... *A63B 23/04* (2013.01); *A63B 21/4034* (2015.10); *A63B 21/4047* (2015.10); *A63B 22/203* (2013.01); *A63B 23/03508* (2013.01); *A63B 69/00* (2013.01); *A63B 69/0002* (2013.01); *A63B 69/3623* (2013.01);
(Continued)

(58) Field of Classification Search
CPC ..... A63B 21/0004; A63B 21/02; A63B 21/04; A63B 21/0442; A63B 21/05–0557; A63B 21/4015; A63B 21/4033–4034; A63B 21/4041; A63B 21/4045; A63B 21/4047–4049; A63B 22/20–203; A63B 23/035–03508; A63B 23/04; A63B 23/0488; A63B 23/08–085; A63B 69/00; A63B 69/0002; A63B 69/18–187; A63B 69/3623; A63B 2069/0004–0011; A63B 2102/18; A63B 2102/182; A63B 2243/007; A63B 2071/025; A63B 69/0093; A63C 17/00–28
See application file for complete search history.

(56) References Cited

U.S. PATENT DOCUMENTS 3,522,953 A * 8/1970 Gold ..... B62K 3/002 482/77
3,559,986 A * 2/1971 Ehrmantraut ..... A63B 23/0488 482/70

(Continued)

*Primary Examiner* — Loan B Jimenez
*Assistant Examiner* — Kathleen M Fisk
(74) *Attorney, Agent, or Firm* — BACON & THOMAS, PLLC

(57) ABSTRACT

An athletic training device includes a wheeled frame, and a rotatable platform disposed on a top of the wheeled frame. The wheeled frame comprises an elongated frame body having a front end and a rear end, wherein a front wheel assembly is disposed at the front end of the frame body, and a rear wheel assembly is disposed at the rear end of the frame body. The rotatable platform is configured to support a user's foot during usage of the athletic training device, and may have a substantially planar upper surface portion for placement of the user's foot. The rotatable platform is mounted to the frame body by a pivoting mechanism so that the rotatable platform freely rotates upon the frame body.

6 Claims, 6 Drawing Sheets

(51) Int. Cl.

| | |
|---|---|
| ***A63B 23/035*** | (2006.01) |
| ***A63B 21/00*** | (2006.01) |
| ***A63B 22/20*** | (2006.01) |
| ***A63B 69/36*** | (2006.01) |
| ***A63B 102/18*** | (2015.01) |

(52) U.S. Cl.
CPC ..... *A63B 2069/0006* (2013.01); *A63B 2069/0008* (2013.01); *A63B 2102/18* (2015.10); *A63B 2102/182* (2015.10); *A63B 2243/007* (2013.01)

(56) References Cited

U.S. PATENT DOCUMENTS

| | | | | | |
|---|---|---|---|---|---|
| 5,458,351 | A * | 10/1995 | Yu | A63C 17/262 | 280/87.043 |
| D430,635 | S * | 9/2000 | Danache | D21/765 | |
| 6,158,752 | A * | 12/2000 | Kay | A63C 17/01 | 280/11.28 |
| 6,733,428 | B2 * | 5/2004 | List | A63B 21/0552 | 482/121 |
| 6,758,483 | B1 * | 7/2004 | Sypniewski | B62M 1/00 | 280/87.041 |
| 6,981,711 | B2 * | 1/2006 | Seta | A63C 17/04 | 280/87.041 |
| 7,237,784 | B1 * | 7/2007 | Monteleone | A63C 17/01 | 280/87.03 |
| 7,931,570 | B2 * | 4/2011 | Hoffman | A63B 23/03533 | 482/129 |
| 10,512,814 | B1 * | 12/2019 | Conroy | A63B 21/00069 | |
| 2009/0227426 | A1 * | 9/2009 | Dubar | A63B 69/0093 | 482/146 |
| 2013/0296147 | A1 * | 11/2013 | Cruz | A63B 69/0093 | 482/146 |

* cited by examiner

ATHLETIC TRAINING DEVICE FOR STRIDE TRAINING

FIELD OF THE INVENTION

The present invention relates an athletic training device, and in particular to an athletic training device for lower half (leg) functional strength training.

BACKGROUND

In rotational sports, mechanical efficiency, or the precision of timing, dictates functional strength training and recovery protocols. In order to improve command in random sports competition, wherein an athlete is competing against an opponent and/or unpredictable elements, it is critical to control as many variables as possible.

Having a strong lower base that can facilitate the timing of separation of the upper half, as well as hold/sustain the generated ground force or foot-pounds in the presence of torque force (rotational speed) should result in the diminishing potential of acute pain and permanent structural damage (injury).

More specifically, in the highest velocity action a human may perform, the throwing motion, the sequence of movement requires an equal amount of lower half and upper half strength. In the absence of lower half stability, performance and wellness equally suffer.

SUMMARY

A training device which assists in training an athletes ability to brace with the front and rear legs under the rotational speed of a swing, throw, punch or similar motion, is desired.

As the front foot lands in such a movement, ground force travels up the kinetic chain to the front hip, which must then facilitate a transition into torque force with isometric strength. As the spine rotates in the direction of release, there must be a sufficient amount of extension and flexibility upon release to provide the most direct tracking pattern.

For every degree of direct tracking (movement along a straight line), the opportunity for speed and accuracy increases. The formula for generating kinetic energy is mass times velocity squared, divided by two—that is, KE=m (v^2)/2. The fastest and most efficient path between two objects is a straight line. Thus, the more directly an athlete tracks into, for example, the release of a ball in a throwing motion, the more velocity may be generated. By extension, with sufficient amount of lower half strength, more energy is created.

With a training device according to the present invention, preparation away from the playing field may be described as a process of decreasing imbalances and malalignments along the spine in isometric, isokinetic and kinetic fashions. In the context of the present invention, "isometric" refers to exercise or motion with the lower half bracing in stillness; "isokinetic" refers to exercise or motion with the lower half bracing against banded resistance; and "kinetic" refers to exercise or motion with the lower half braced throughout the completion of a motion such as a throw, swing or punch demanding the lower half to brace in all positions. The strategic implementation of exercises that promote a strong cross sectional relationship from head to toe will insure that the coach, and or player may target the weak link or position of limitation in a given athletic movement.

A training device according to the present invention gives the coach and athlete the highest understanding of what it means and how it feels to move as direct as possible, under variable resistance protocols—for example, heavy and light baseball bat or golf club swings, weighted baseball, football or softball throws, and the like, under varying amounts of band resistance.

Without a developed base of functional strength, an athlete cannot explore the limits of their genetically predisposed potential. The athletic training device of the present invention explicitly defines and develops how much functional strength a given athlete possesses as well as simultaneously illustrating the degree of functional strength deficit. This knowledge creates a clear path and grounds for programming a protocol that may enable the end user to pursue the very limits of their ability in a controlled setting.

The training device according to the present invention comprises a wheeled frame, and a rotatable platform disposed on a top of the wheeled frame. The wheeled frame comprises an elongated frame body having a front end and a rear end, wherein a front wheel assembly is disposed at the front end of the frame body, and a rear wheel assembly is disposed at the rear end of the frame body. The rotatable platform is configured to support a user's foot during a training exercise using the athletic training device, and may have a substantially planar upper surface portion for placement of the user's foot. The rotatable platform is mounted to the frame body by a pivoting mechanism so that the rotatable platform freely rotates upon the frame body.

The athletic training device can be used in a variety of different ways pertaining to the development of sound athletic movements such as running, throwing, swinging and punching. In particular, any skills task that entails a measurably imperative stride length and or rotational efficacy may benefit through the use of a training device according to the present invention in a controlled training environment. Equally, the athletic training device can be utilized in rehabilitation capacity, where the user may be trained on a program monitored by a physical therapist or other qualified personnel, with the goal of improving or returning to a quality of life that promotes wellness and pain free status. The training device according to the present invention may be used in conjunction with other pieces of physical therapy equipment such as, but not limited to, elastic bands, weights and the like.

BRIEF DESCRIPTION OF THE DRAWINGS

Similar reference characters denote corresponding features consistently throughout the attached drawings.

DETAILED DESCRIPTION OF VARIOUS EMBODIMENTS

Figure 1:
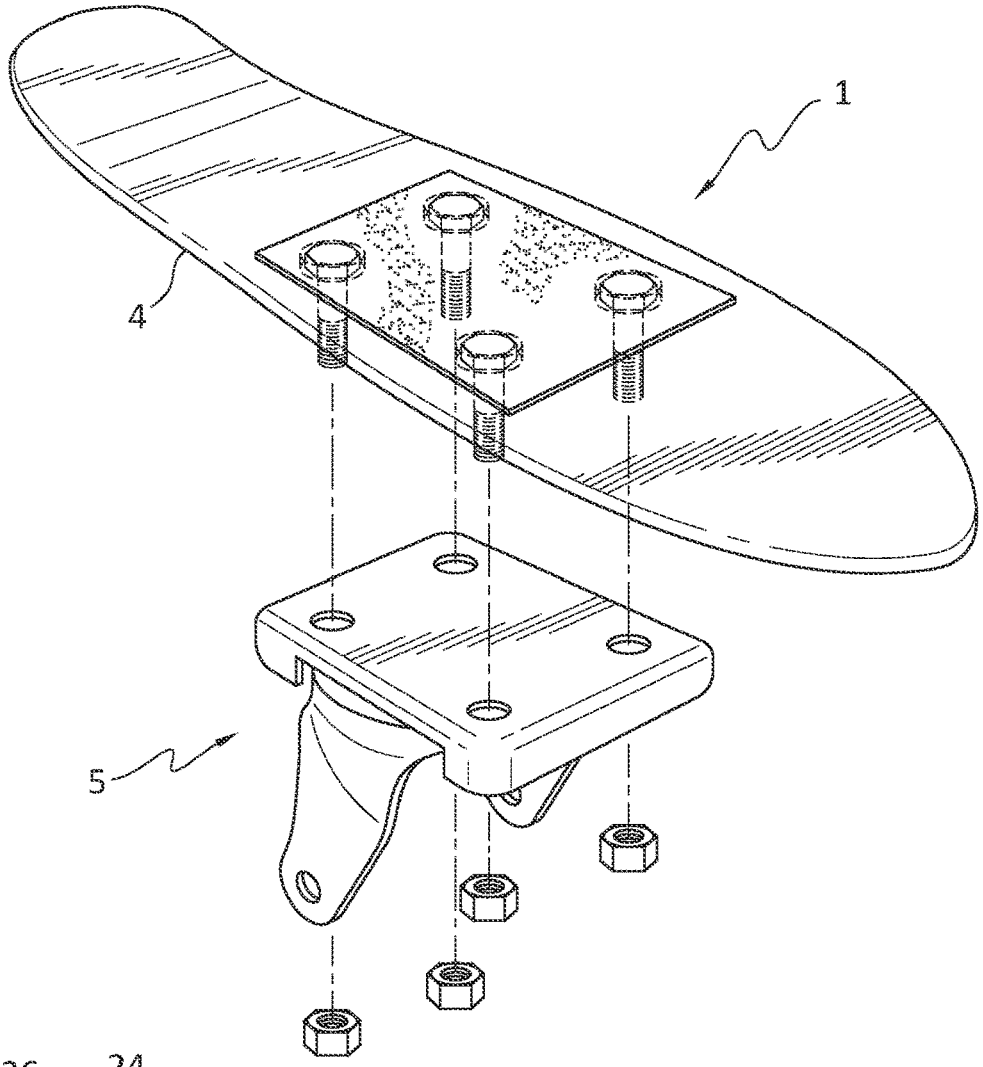
FIG. 1 is an exploded perspective view of one embodiment of the athletic training device of the present in invention.
Figure 1:
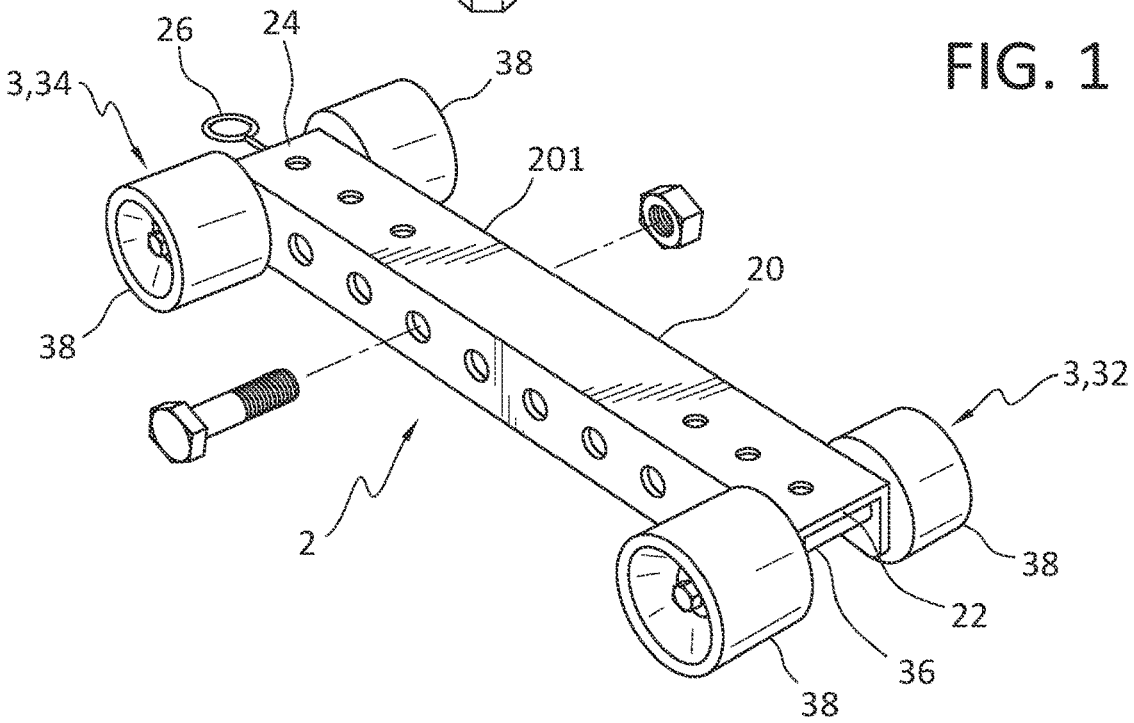
Figure 2:
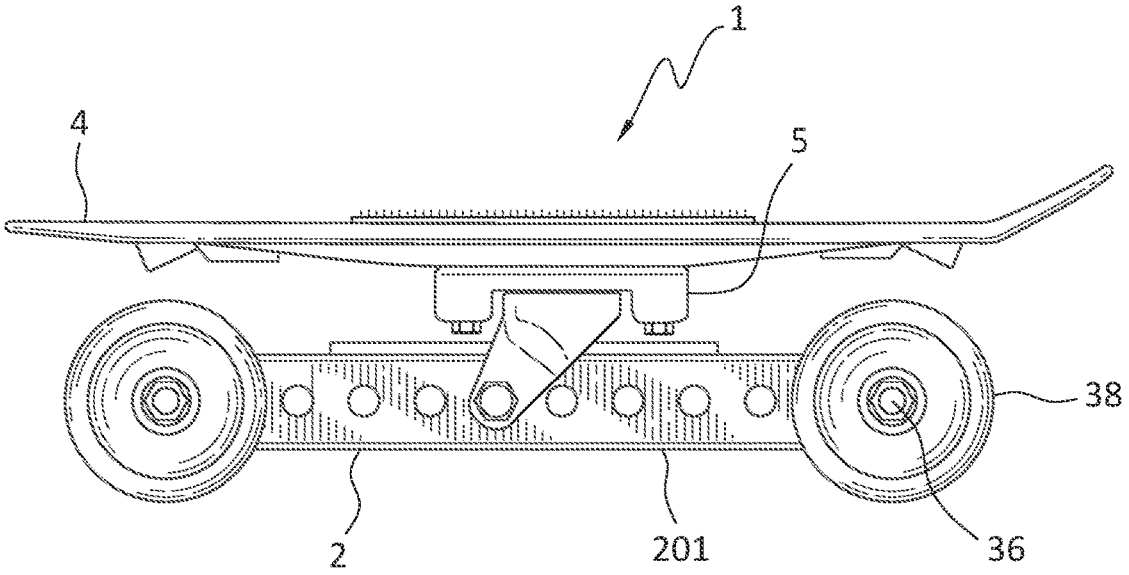
FIG. 2 is side view of the athletic training device shown in FIG. 1.
Figure 3:
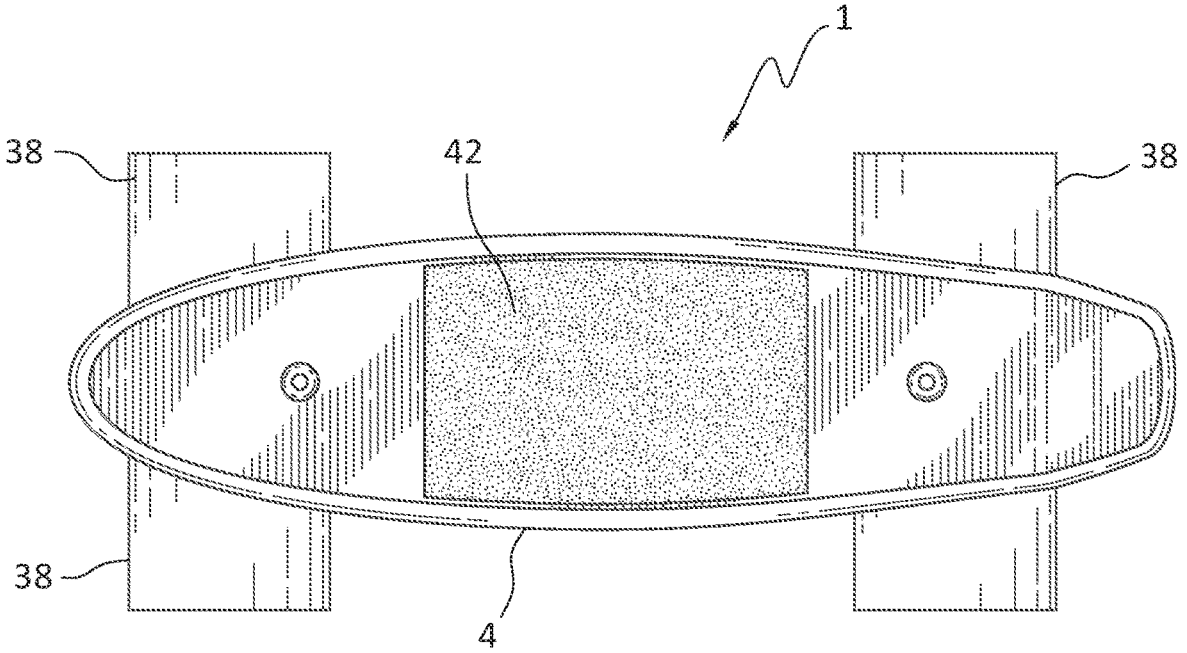
FIG. 3 is a top of the athletic training device shown in FIG. 1, showing the rotatable platform in a first orientation.
Figure 4:
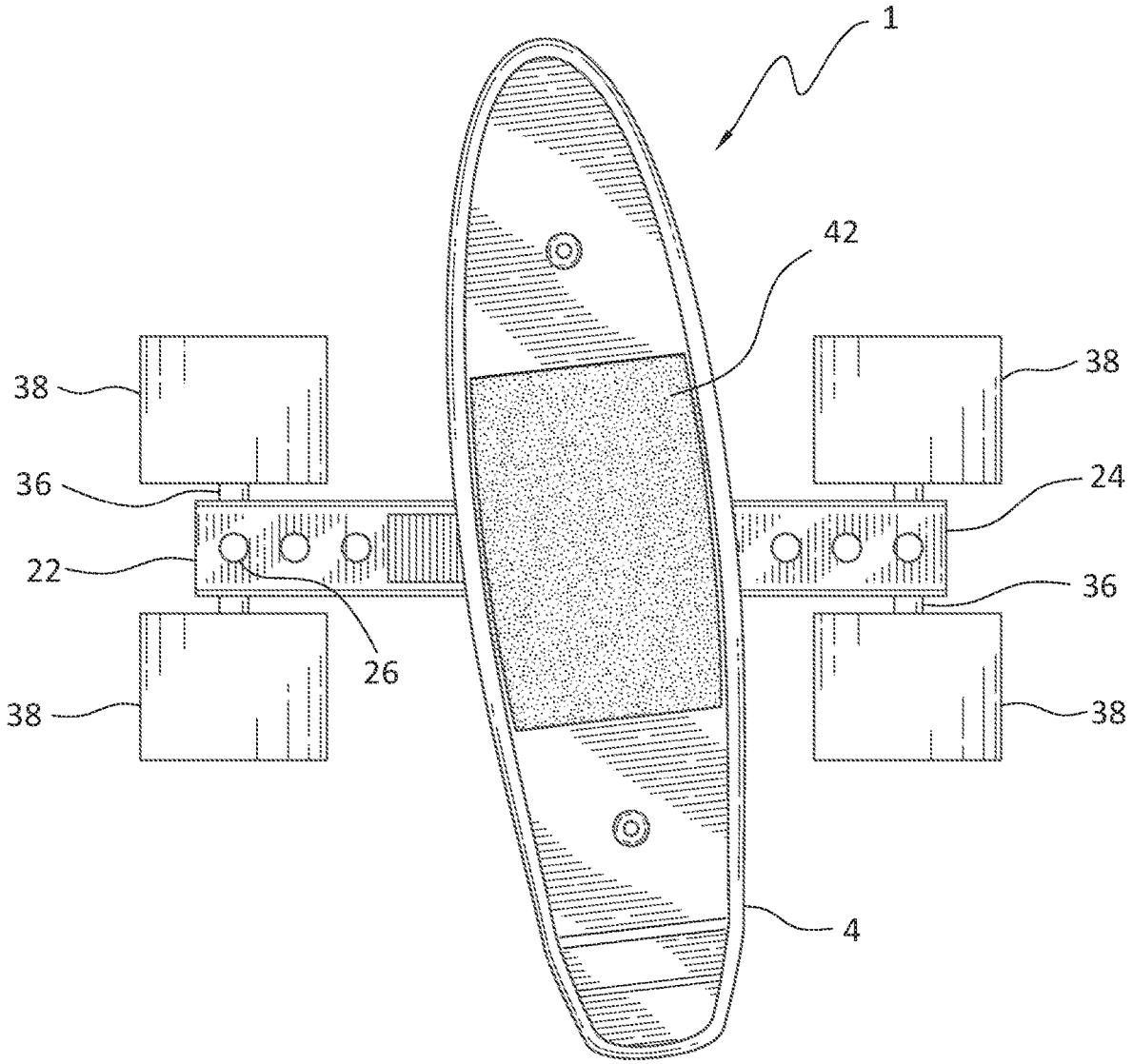
FIG. 4 is a top of the athletic training device shown in FIG. 1, showing the rotatable platform in a second orientation.

Referring to FIGS. 1-4, an athletic training device 1 comprises a wheeled frame 2, and a rotatable platform 4 disposed on a top of the wheeled frame 2. The wheeled frame 2 comprises an elongated frame body 20 having a front end 22 and a rear end 24, wherein wheels 38 are fixed to the frame body 20 to allow rolling movement of the wheeled frame 2 on a surface. Generally, a pair of front wheels 38 are disposed proximately to the front end 22, and a pair of rear wheels 38 are disposed proximately to the rear end 24. In the illustrated embodiment, wheel assemblies 3 are arranged on the frame body 20 as a front wheel assembly 32 disposed at the front end 22 of the frame body 20, and a rear wheel assembly 34 disposed at the rear end 24 of the frame body 20.

Each of the wheel assemblies 3 comprises an axle 36 and a pair of wheels 38, with a wheel 38 at each end of the axle 36. In the illustrated embodiment, each of the axles 36 is directly attached to the frame body 20. In particular, in the illustrated embodiment, each axle 36 passes through the frame body 20 to fasten the axle 36 to the frame body 20. Alternatively, the axles 36 may be mounted onto a surface of the frame body 20. In other embodiments, the axles 36 may be mounted to the frame body 20 with a mounting bracket or the like. Preferably, the axles 36 are mounted to the frame body 20 in a fixed, immovable manner so that a rolling movement of the frame body 20 along a surface is confined to a straight linear fore-and-aft movement.

The rotatable platform 4 is configured to support a user's foot during usage of the athletic training device 1, and may have a substantially planar upper surface portion for placement of the user's foot. The rotatable platform 4 is mounted to the frame body 20 by a pivoting mechanism 5 so that the rotatable platform 4 freely rotates upon the frame body 20. Preferably, the rotatable platform 4 is capable of full 360 degree rotation.

Figure 5:
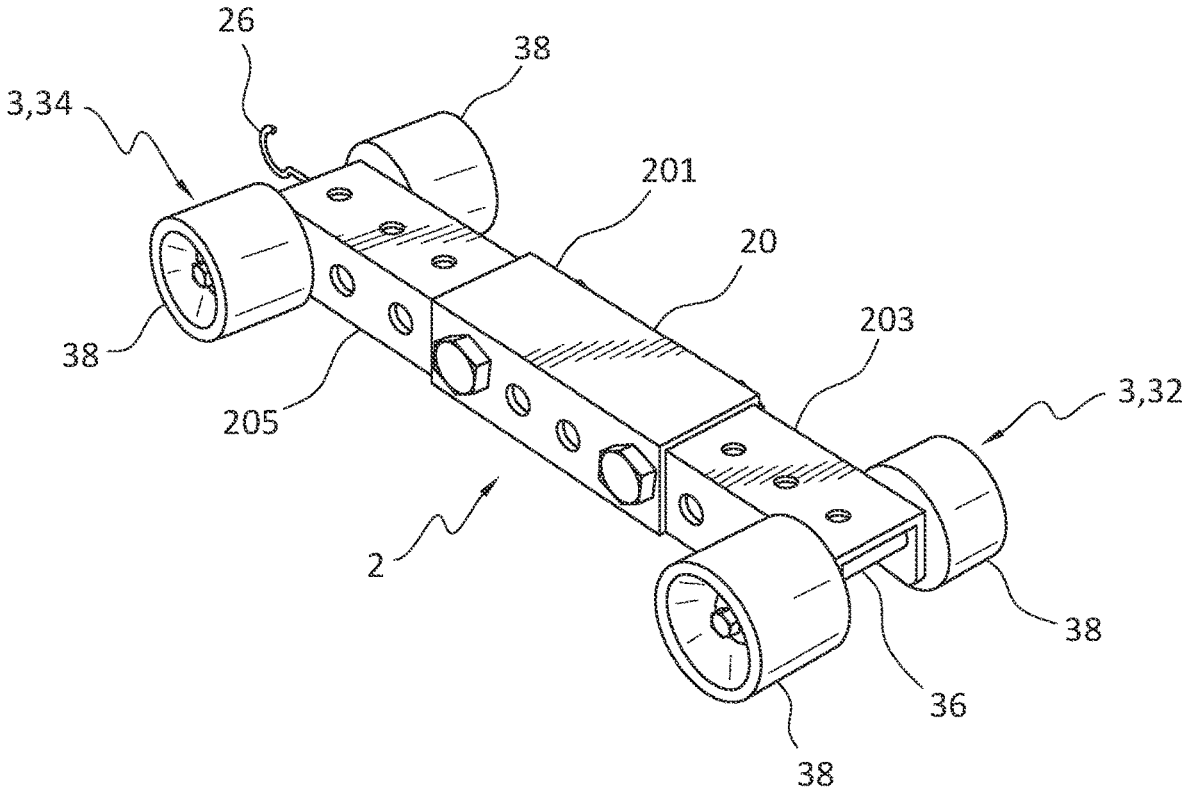
FIG. 5 is a perspective view of an alternative embodiment of the wheeled frame.

In certain embodiments such as shown in FIG. 5, the frame body 20 may be variable in length, and may comprise at least one of a front 203 and a rear 205 extension telescopically coupled to the main body portion 201. In other embodiments, the frame body 20 may be fixed in length, and may be defined by a single body element. In the embodiment of FIG. 5, the rotating platform will be affixed to the main body portion 201.

The front and rear wheel assemblies 32, 34 are, in a preferred embodiment, mounted to the frame body 20 in a fixed manner to prevent turning movement of the athletic training device 1 when rolled fore and aft, confining the athletic training device 1 to a liner rolling movement. That is, in such an embodiment, the front and rear wheel assemblies 32, 34 comprise a plurality of wheels 38 connected to frame body 20 in a manner to restrict a rolling movement of the wheeled frame 2 to a linear forward and rearward rolling movement.

In other embodiments, the front and rear wheel assemblies 32, 34 may each, or individually, provide for a degree of tilt or rotation to allow or cause the athletic training device 1 to roll fore and aft in a fixed or variable arcuate path, as may be applicable to specialized training exercises.

The rotatable platform 4 is adapted to support a user's foot, and accordingly is preferably dimensioned relative to a size or range of sizes to accommodate the user's foot. For example, the rotatable platform 4 may be an elongated rectangular, ovoid or other shape having a length of 10-20 inches, and a width of approximately 4-6 inches. Other dimensions are contemplated and may vary according to a footwear associated with sporting exercises to be performed with the training device 1. The rotatable platform 4 may be provided with a non-skid material applied to a top surface 42, or the top surface 42 may be formed to have a non-skid property.

The frame body 20 may be adapted allow for attachment of one or more elastic bands to add a resistance component to exercises performed with the training device 1. For example, one or more band attachments 26 may be provided as a hook or loop extended from or formed within the frame body 20, or as an aperture or passage through the frame body 20 adapted to receive and secure an end or portion of one or more elastic bands.

Figure 6:
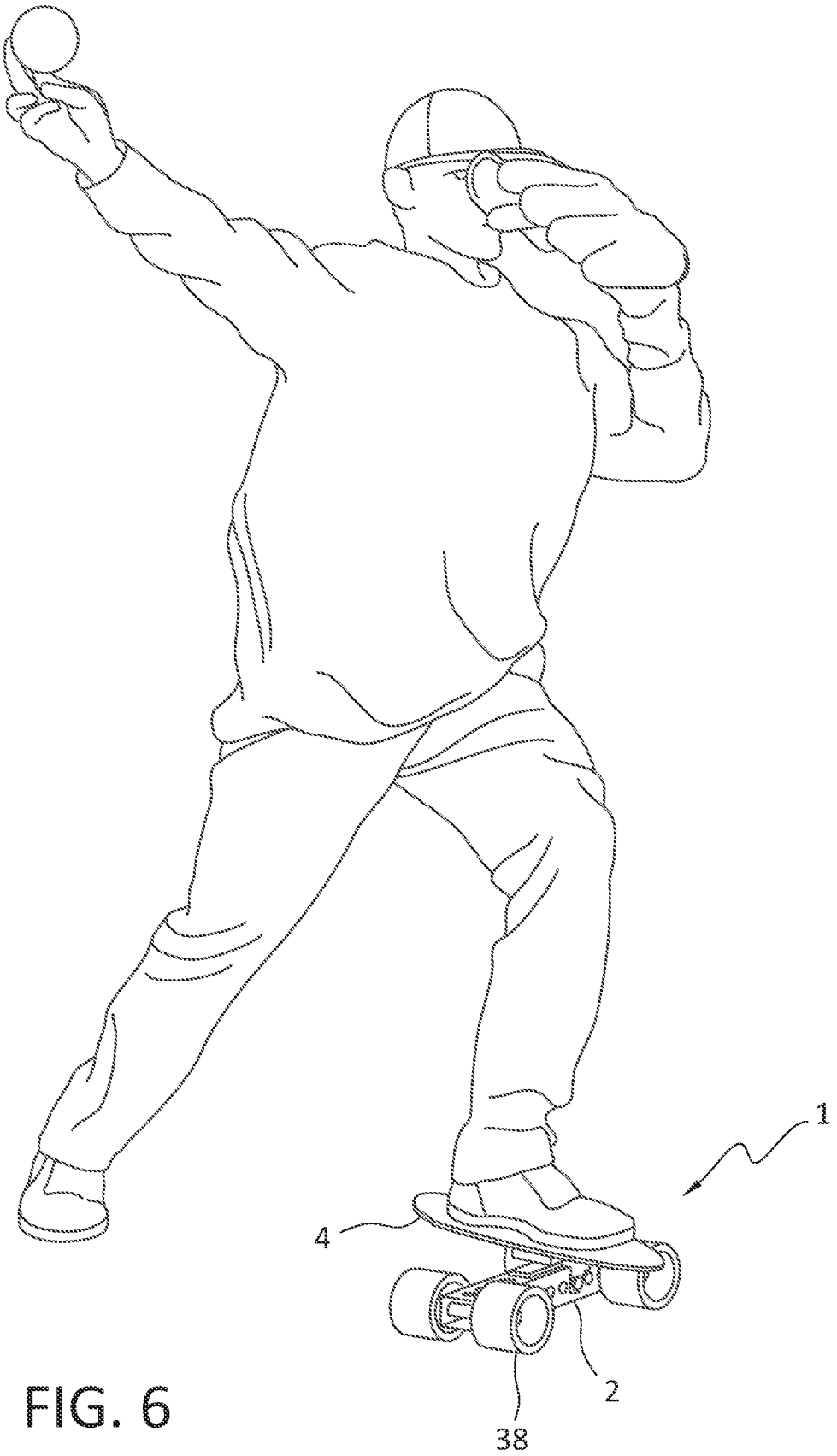
FIG. 6 is a perspective view showing an embodiment of the athletic training device in use in a training exercise.
Figure 7:
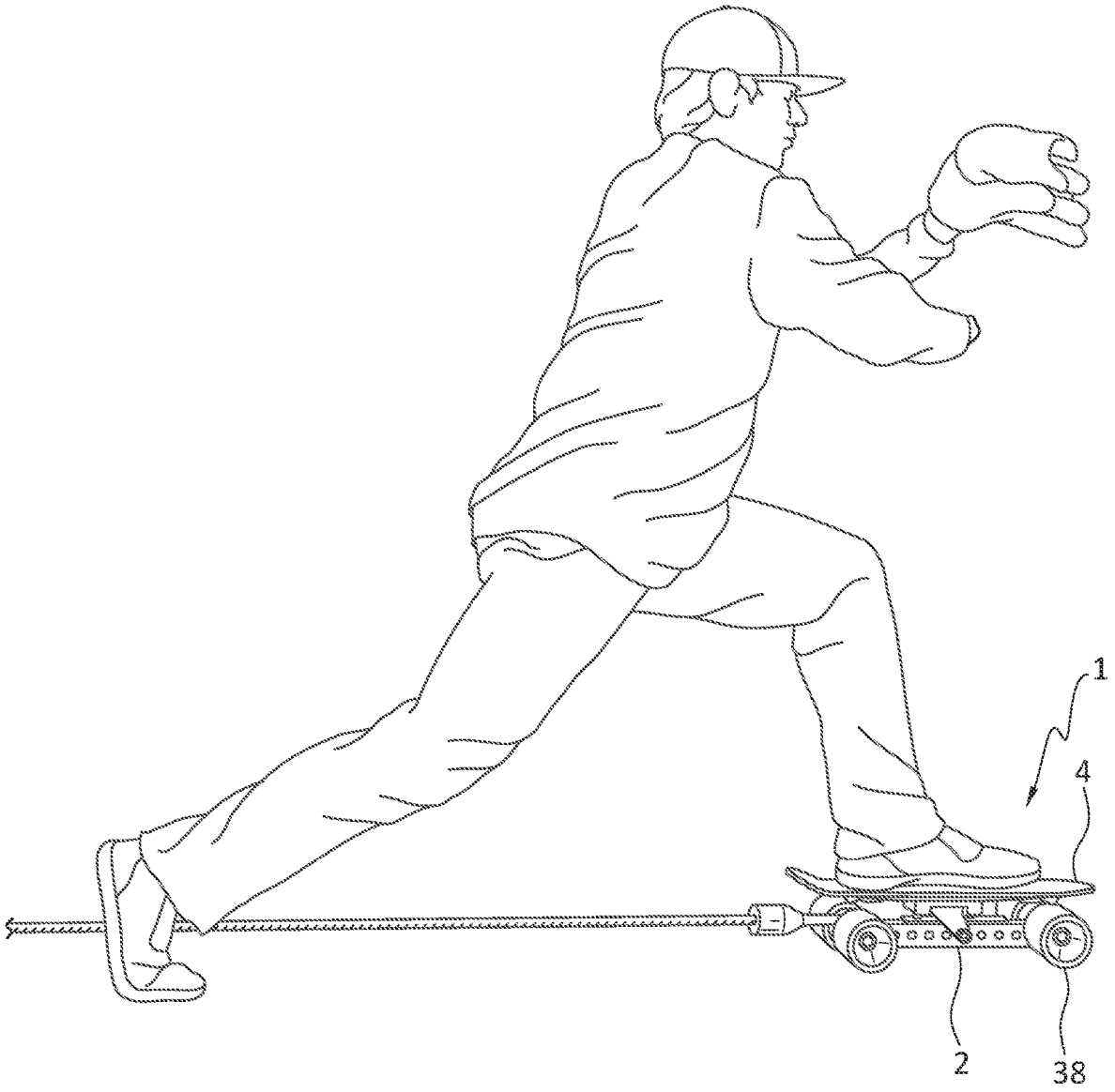
FIG. 7 is a perspective view showing an embodiment of the athletic training device in use in a training exercise.

Referring to FIGS. 6 and 7, the athletic training device 1 is useful for certain athletic training exercises. For example, the athletic training device 1 may be used advantageously for exercises focusing on stride training and development. The manner of use is quite diverse. In one example of usage, a user may place their lead foot onto the rotatable platform 4, while striding from a starting position to an appropriate distance in or corresponding to a swinging or throwing motion (such as swinging a baseball bat, or throwing a ball), and subsequently returning to the starting position. The motion may be performed with or without the use of a complementary equipment such as a club, baseball bat, weight or the like. The rotatable platform 4 accommodates training in various positions of the user's body, such as with hips parallel or perpendicular to a given target, as well as turning or pivoting of the user's body (foot, leg, hips) through the stride motion. For example, performing an exercise repetition with the training device oriented to roll forward and backward relative to the athlete (see FIG. 7) provides a primary constraint or demand upon the hip to stabilize in a flexion/extension pattern, while performing another exercise repetition with the training device oriented to roll sideways (see FIG. 6) presents a primary challenge to stabilize laterally, rather through hip adduction and abduction. In this context, "primary challenge" refers to the focus or targeted regions of an exercise—all key stabilizers from head to toe must facilitate a powerful and efficient movement. However, the magnitudinal demand upon the lower half mechanics is the segment of the kinetic chain under constraint during such illustrated drills.

Training exercises with the training device 1 may be further specialized or adapted by the use of elastic bands.

I claim:

1. An athletic training device, comprising:

a wheeled frame, and a platform rotatably fixed to a top of the wheeled frame;

wherein the wheeled frame comprises a frame body having a front end and a rear end, a plurality of apertures being formed through the frame body and being adapted for attachment of at least one elastic resistance band;

wherein a front wheel assembly is disposed at the front end of the frame body, and a rear wheel assembly is disposed at the rear end of the frame body, the front and rear wheel assemblies being arranged in a manner to constrain a rolling movement of the wheeled frame to a linear fore-and-aft movement;

wherein the rotatable platform is an elongated platform having a length greater than a width, the rotatable platform being configured to support a user's foot during usage of the athletic training device; and wherein said frame body comprises a main body portion and an extension part telescopically coupled to the main body portion whereby the frame body is adjustable in length.

2. The athletic training device according to claim 1, wherein said front wheel assembly comprises a front axle attached proximately to said front end of the frame body and a pair of wheels each disposed on opposite ends of said axle.

3. The athletic training device according to claim 1, wherein said rear wheel assembly comprises a rear axle attached proximately to said rear end of the frame body and a pair of wheels each disposed on opposite ends of said axle.

4. The athletic training device according to claim 2, wherein said front axle is fixed to said front end of the frame body to prevent a steering movement of the front axle relative to the frame body.

5. The athletic training device according to claim 3, wherein said rear axle is fixed to said rear end of the frame body to prevent a steering movement of the rear axle relative to the frame body.

6. The athletic training device according to claim 1, wherein said front wheel assembly and said rear wheel assembly comprise a plurality of wheels connected to said frame body in a manner to restrict a rolling movement of the wheeled frame to a linear forward and rearward rolling movement.

* * * * *